US008584598B2

(12) United States Patent
Derkoski

(10) Patent No.: US 8,584,598 B2
(45) Date of Patent: Nov. 19, 2013

(54) COLLAPSIBLE TABLE

(76) Inventor: Barbara Derkoski, Little Egg Harbor, NJ (US)

( * ) Notice: Subject to any disclaimer, the term of this patent is extended or adjusted under 35 U.S.C. 154(b) by 224 days.

(21) Appl. No.: 13/065,256

(22) Filed: Mar. 17, 2011

(65) Prior Publication Data

US 2012/0237142 A1 Sep. 20, 2012

(51) Int. Cl.
*A47B 57/00* (2006.01)

(52) U.S. Cl.
USPC ..... 108/14; 108/65

(58) Field of Classification Search
USPC ..... 108/65, 67, 83, 14, 156, 34, 64, 166, 108/167, 169, 171, 174
See application file for complete search history.

(56) References Cited

U.S. PATENT DOCUMENTS

| | | | | | |
|---|---|---|---|---|---|
| 2,101,573 | A | * | 12/1937 | Cramer et al. | 108/64 |
| 2,694,609 | A | * | 11/1954 | Trafford | 108/64 |
| 2,857,223 | A | | 10/1958 | Furey | |
| 2,862,777 | A | * | 12/1958 | Paige | 108/34 |
| 2,875,008 | A | * | 2/1959 | Grodsky | 108/62 |
| 3,421,459 | A | | 1/1969 | Sherwood | |
| 4,915,034 | A | | 4/1990 | Grabe et al. | |
| 5,144,888 | A | | 9/1992 | Heine et al. | |
| 5,487,536 | A | | 1/1996 | McEachin | |
| 5,560,302 | A | | 10/1996 | Diffrient et al. | |
| 6,032,590 | A | * | 3/2000 | Chen | 108/158.12 |
| 6,324,997 | B1 | | 12/2001 | Baker | |
| 6,536,358 | B1 | * | 3/2003 | Fears | 108/116 |
| 6,629,506 | B2 | * | 10/2003 | Park | 108/156 |
| 6,776,105 | B2 | * | 8/2004 | Rivera et al. | 108/34 |
| 7,255,314 | B2 | | 8/2007 | Hanson et al. | |
| 7,950,336 | B2 | * | 5/2011 | Phillips | 108/64 |
| 8,146,517 | B1 | * | 4/2012 | Masser et al. | 108/64 |
| 2003/0133071 | A1 | * | 7/2003 | Ahn | 351/110 |

* cited by examiner

*Primary Examiner* — Janet M Wilkens
(74) *Attorney, Agent, or Firm* — Norman E. Lehrer

(57) ABSTRACT

A collapsible table includes two end table sections and an intermediate table section each having an upper substantially planar surface and a lower surface. Each table section is comprise of two substantially equal halves hinged together along the length of the table section whereby the two halves can be moved between an operative position wherein the table section exhibits a continuous upper substantially planar surface and an inoperative folded position wherein the lower surfaces of each half are in substantial contact. The inner edges of each table section include a plurality of holes therein which allows the table section to be temporarily connected to an adjacent table section through the use of rods that fit into the holes. A plurality of legs is adapted to be temporarily connected to the underside of each table section. A carrying bag capable of containing said table therein and including a handle for carrying the same is also provided.

6 Claims, 6 Drawing Sheets

COLLAPSIBLE TABLE

BACKGROUND OF THE INVENTION

The present invention is directed toward a collapsible table and more particularly, toward a collapsible table that can be easily set up or taken down, which can be easily transported and which can be enlarged (or made smaller) by adding (or removing) sections to the interior thereof.

Although it may have numerous other uses, the present invention has particular use as a temporary table such as a dinner table for picnics or outside parties or the like. I may also be used indoors in addition to or in lieu of an existing dining table for serving a large number of guests.

When going to a picnic or outing, people frequently must bring a table with them. In order to be able to be carried in a car or other personal vehicle, such portable tables must be able to be folded to a reasonably small size. In addition, to be sturdy enough to support several people eating thereon, such tables must also be relatively heavy. This is not a major problem for very small tables but becomes difficult for larger tables.

Furthermore, because tables are normally of a fixed size, people must own several different sized tables or must carry two or more small tables with them depending on the number of people who may be using the tables. This, of course, adds expense and inconvenience.

Folding tables are well known in the art. They range from very heavy and sturdy tables that fold in half at the center and with folding legs to simple card tables with folding legs. The heavy tables are difficult to carry around and the smaller card tables can be quite flimsy and often too small for use. Such card tables, however, may still be too large to be conveniently carried in a car.

There have, in the past, been proposals to provide several tables that can be connected to make larger tables. These are described, for example, in U.S. Pat. Nos. 2,857,223; 3,421,459; 4,915,034 and 5,144,888. None of these prior art tables, however, is suitable for use as a portable picnic or dining table or the like. These tables are heavy, do not fold to small sizes and have somewhat complicated mechanisms for connecting the various sections together.

U.S. Pat. No. 5,487,536 illustrates a rather simple means for connecting two tables together to make a larger table that includes a plurality of pins extending horizontally from the side edge of one table and a plurality of complementary holes in the side edge of an adjacent table into which the pins are inserted. The table disclosed in this patent, however, is a specialized cutting table that is quite massive and can neither be folded nor easily transported.

There is, therefore, a need for a collapsible and expandable table that is light in weight so that it can be easily carried and which can be easily set up when needed and easily taken down to be transported when not in use.

SUMMARY OF THE INVENTION

The present invention is designed to overcome the deficiencies of the prior art discussed above. It is an object of the present invention to provide a collapsible table that is easy to assemble and disassemble.

It is another object of the present invention to provide a collapsible table that is sturdy but light enough to carry about easily.

It is a further object of the present invention to provide a collapsible table that can easily be expanded to increase the size thereof when desired.

In accordance with the illustrative embodiments demonstrating features and advantages of the present invention, there is provided a collapsible table that includes two end table sections and an intermediate table section each having an upper substantially planar surface and a lower surface. Each table section is comprise of two substantially equal halves hinged together along the length of the table section whereby the two halves can be moved between an operative position wherein the table section exhibits a continuous upper substantially planar surface and an inoperative folded position wherein the lower surfaces of each half are in substantial contact. The inner edges of each table section include a plurality of holes therein which allows the table section to be temporarily connected to an adjacent table section through the use of rods that fit into the holes. A plurality of legs is adapted to be temporarily connected to the underside of each table section. A carrying bag capable of containing said table therein and including a handle for carrying the same is also provided.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
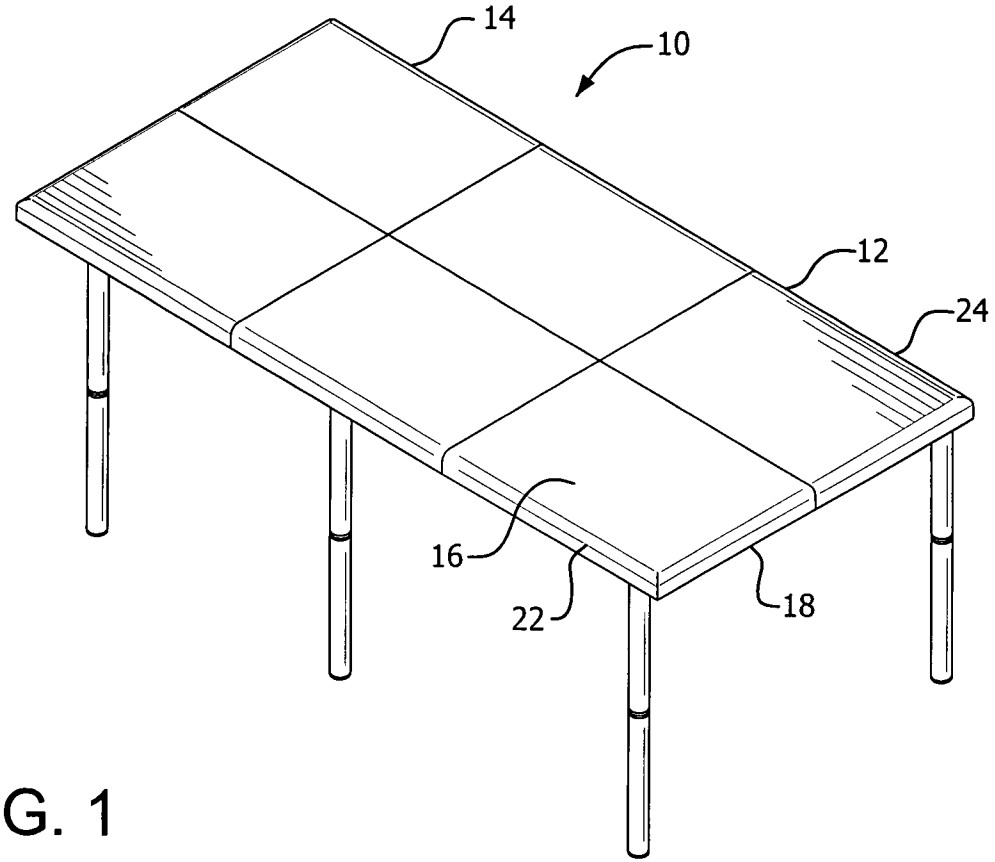
FIG. 1 is a perspective view of the table of the present invention fully assembled for use.

Referring now to the drawings in detail wherein like reference numerals have been used throughout the various figures to designate like elements, there is shown in FIGS. 1-6 a collapsible table constructed in accordance with the principles of the present invention and designated generally as 10.

The collapsible table 10 of the present invention essentially includes a first end table section 12 and a second end table section 14. As will become readily apparent hereinafter, end table section 12 and end table section 14 are identical to each other and are interchangeable whereby either one can be used at either end of the table 10. For this reason, a description of only one of the end table sections 12 and 14 will be provided in detail, it being understood that the other end table section is constructed and arranged in the identical manner.

Each end table section has an upper substantially planar surface 16 that serves as the table top and has a length of between 20 to 30 inches (preferably 24 inches) and a width of between 30 to 48 inches (preferably 40 inches). These dimensions are, of course, by way of example only as other dimensions are also possible. Each end table section includes an outer edge 18 that runs the width of the table and an inner edge 20 that also runs the width of the table. Opposed side edges 22 and 24 extend the length of the end table section.

As can be seen, the outer edge 18 and the side edges 22 and 24 are finished. They may have, for example, a rounded or chamfered contour. The inner edge 20, on the other hand, is preferably comprised of an unfinished vertical wall having a plurality of holes such as shown at 26 and 28 that extend into the direction of the length of the table. The holes, such as shown at 26 and 28 have a rectangular shape.

Figure 2:
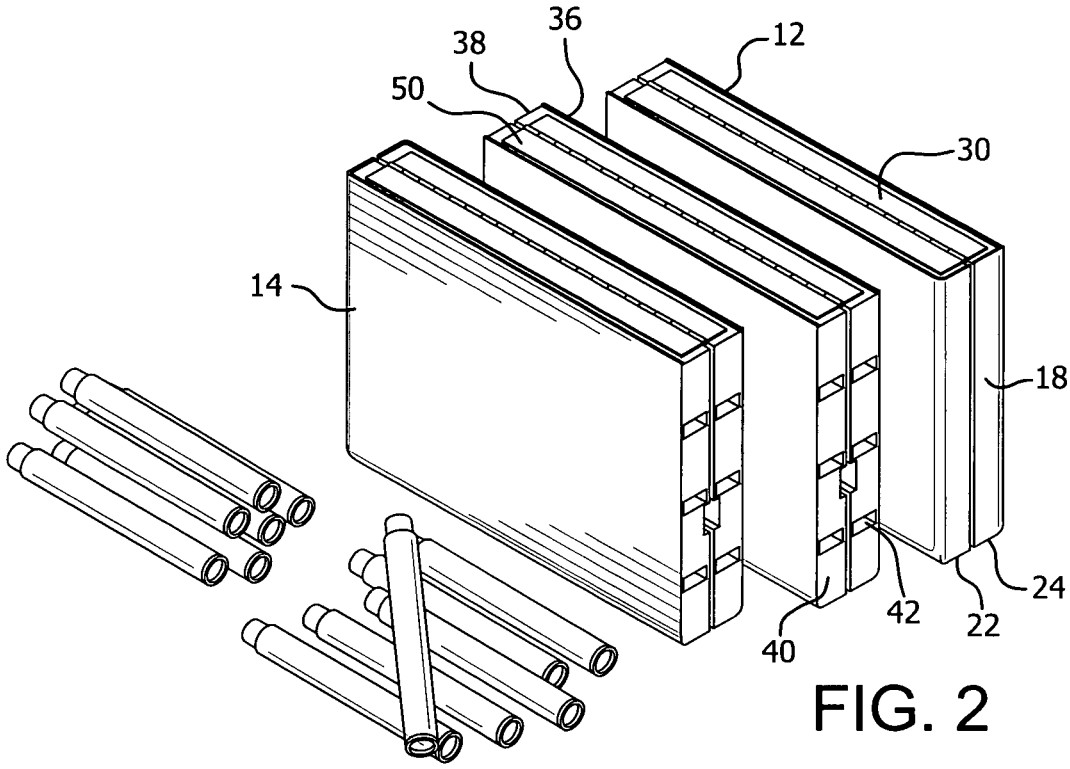
FIG. 2 is a perspective view of the table of the present invention fully disassembled and ready to be put into a bag to be carried.
Figure 3:
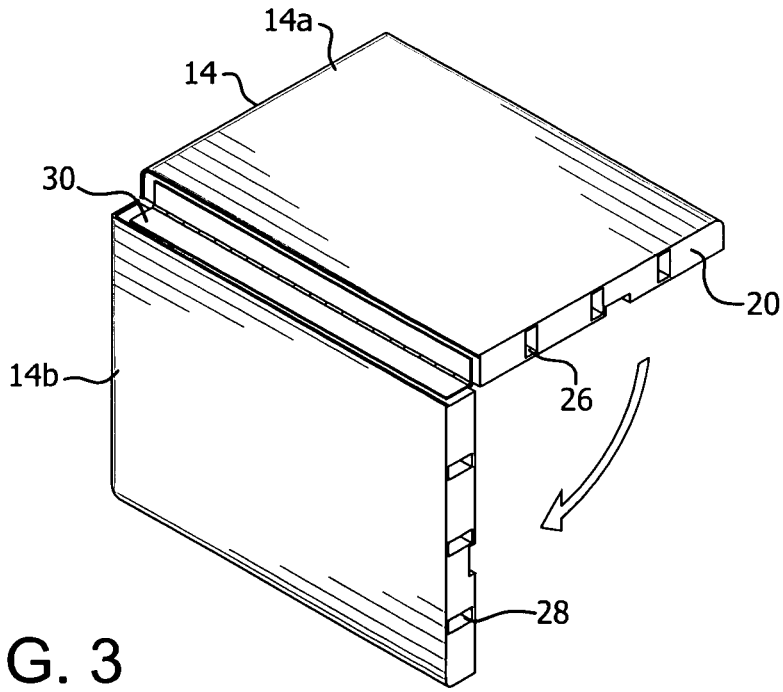
FIG. 3 is a perspective view showing how each table section of the invention can be folded in half.

As shown most clearly in FIG. 3, each of the two end table sections such as end table section 14 is actually comprised of two substantially equal halves 14*a* and 14*b*. A hinge 30 connects the two halves 14*a* and 14*b* together along their length so that the two halves can be moved between an operative position such as shown in FIG. 1 wherein the end table section exhibits a continuous upper substantially planar surface with the side edges 22 and 24 spaced apart from each other and an inoperative or folded position such as shown in FIG. 2 wherein the lower surfaces of the hinged halves are in substantial contact and the side edges 22 and 24 are next to each other. The hinge 30 is preferably a continuous elongated hinge commonly referred to as a piano hinge.

Figure 4:
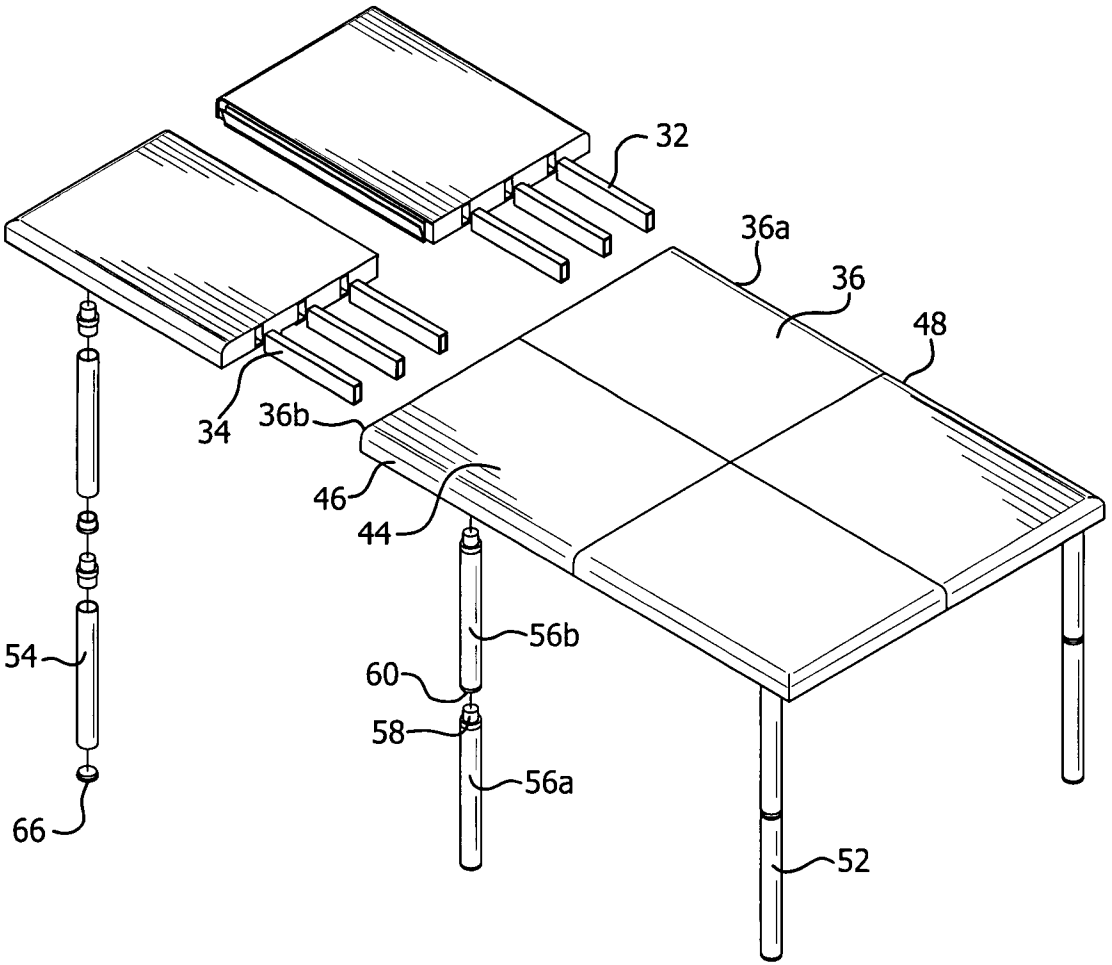
FIG. 4 is a perspective view of the table of the present invention illustrating how table sections are connected together and how the legs are connected.

The collapsible table 10 of the present invention also includes a plurality of rectangularly shaped rods such as shown at 32 and 34 in FIG. 4 that are complementary in shape to the holes 26 and 28 and can be inserted therein. The rods 32 and 34 are, of course, inserted only partially into the length of the table top as shown best in FIG. 6 so that they extend outwardly therefrom. This allows the exposed ends of the rods to be inserted into the openings in the other of the two end table sections so as to form a single table top.

In order to make the table 10 larger, however, an intermediate table section 36 is provided. The intermediate table section 36 is constructed in essentially the same manner as the first and second end table sections 12 and 14 except that it has two unfinished opposed inner edges 38 and 40. Each of these inner edges also includes a plurality of rectangularly shaped holes 42 therein that are also complementary to the rods 32 and 34.

Much like the first and second end table sections 12 and 14, the intermediate table section 36 includes an upper substantially planar surface 44 with finished opposed side edges 46 and 48. The overall width of the intermediate table section 36 is equal to the width of the two end sections and may have any desired length such as 24 to 30 inches by way of example. The intermediate section 36 is also comprised of two parts 36*a* and 36*b* that are hinged together by hinge 50 so as to be movable in the identical manner as the two end sections 12 and 14.

Figure 5:
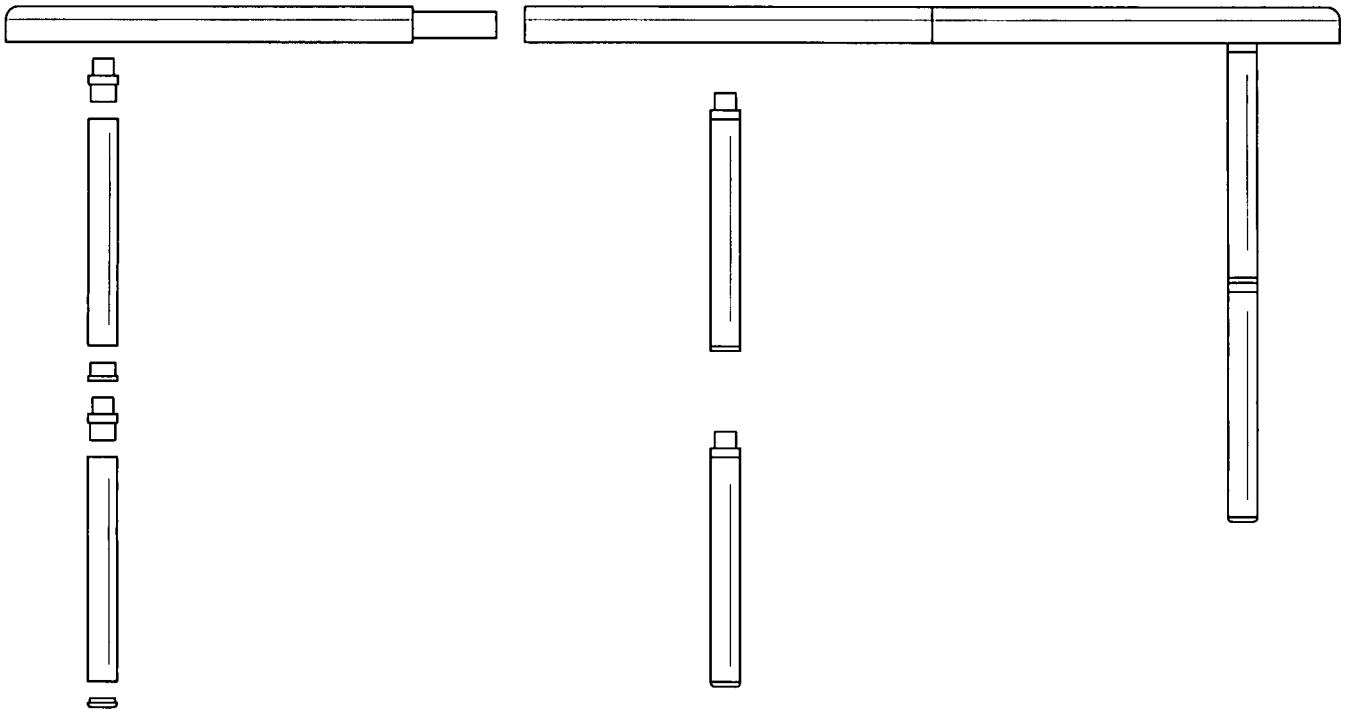
FIG. 5 is a side elevational view of the table of the present invention further illustrating how table sections are connected together and how the legs are connected.

Also provided is a plurality of legs such as shown, for example, at 52 and 54 in FIGS. 1 and 4. In the preferred embodiment, six legs are provided: two for each of the end table sections 12 and 14 and two for the intermediate table section 36. As shown in FIGS. 2, 4 and 5, each leg is actually comprised of two equal and interchangeable parts such as shown at 56*a* and 56*b*. The upper end of each leg part has a reduced diameter 58 that fits into a complementary opening 60 at the bottom of each leg half. For ease of assembly, all of the upper and lower leg halves are equal to each other and interchangeable and all of the six legs, in the example of the preferred embodiment of the invention, are interchangeable. Furthermore, and as can be seen, since the outer circumference of each upper and lower leg part is the same, either part can function as the top and either part can function as the bottom.

Figure 6:
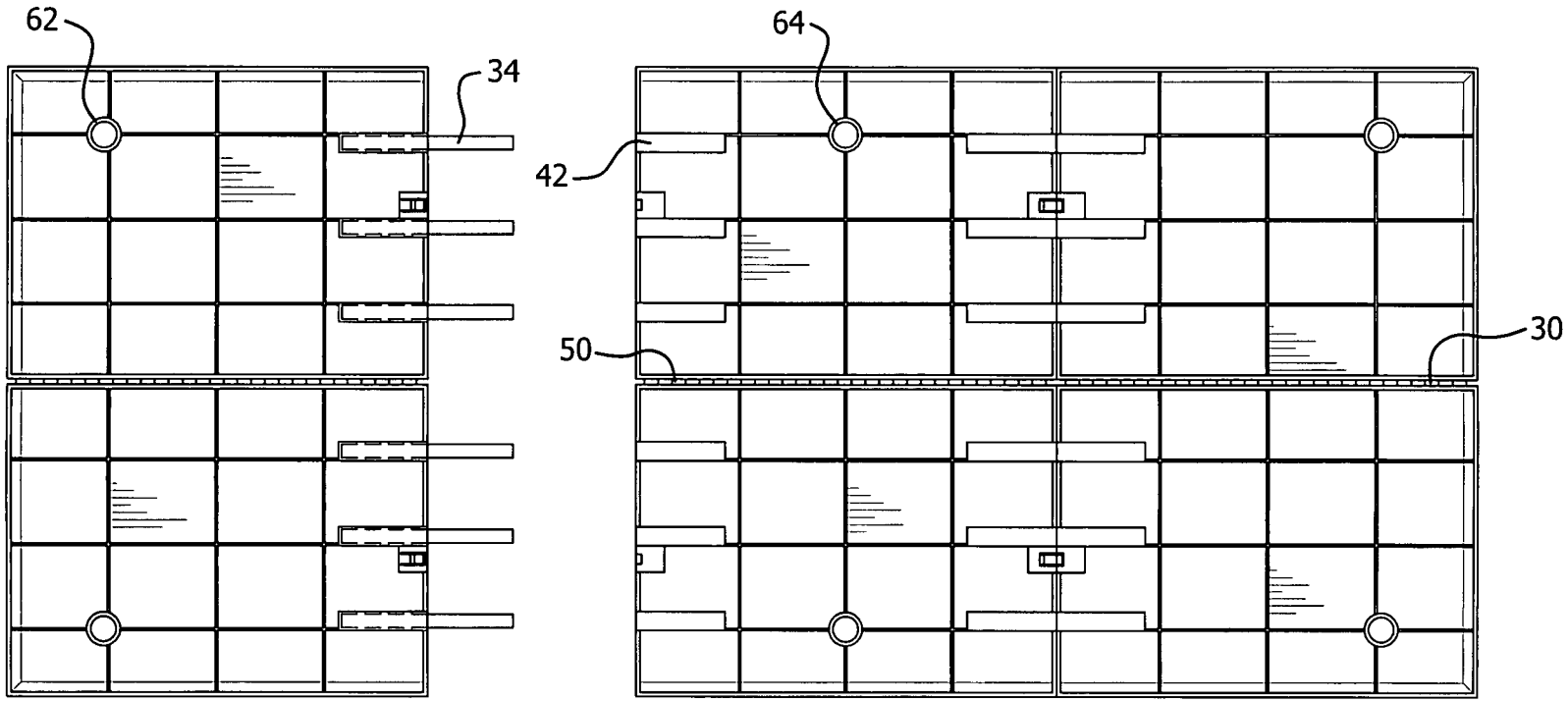
FIG. 6 is a bottom plan view of the table of the present invention again showing how table sections are connected together.

As shown most clearly in FIG. 6, the lower surface of the several table sections includes vertical openings therein such as shown at 62 and 64. In the preferred embodiment, there are six such openings, two being located on the lower surface of each of the table sections. The size and shapes of the openings 62 and 64 correspond to the shape of the upper parts 58 of each of the legs thereby allowing the legs to be inserted into the openings. Preferably, the legs are held in place simply by friction fit. However, it is not beyond the scope of the present invention to provide a threaded or bayonet or other type of connection. If desired, the lowermost end of each leg may also be provided with a protective cap such as shown at 66 in FIG. 4 or some other wear-resistant material.

All of the component parts of the present invention (with the exception of the hinges) are made of a rigid plastic material. This allows the table to be made relatively light and inexpensive since it can be molded. Of course, other materials other than plastic could be used and other manufacturing procedures could be utilized and still fall within the scope of the invention.

Assembly and/or disassembly of the table is relatively easy and is illustrated in the various figures. Utilizing the various component parts of the table 10 shown in FIG. 2, each table section is opened up into its operative position wherein the three table sections are connected together utilizing the plurality of holes and rods on the inner edges. The legs are then assembled together and are inserted into the openings in the undersurface of the table sections to form a completed table.

Figure 7:
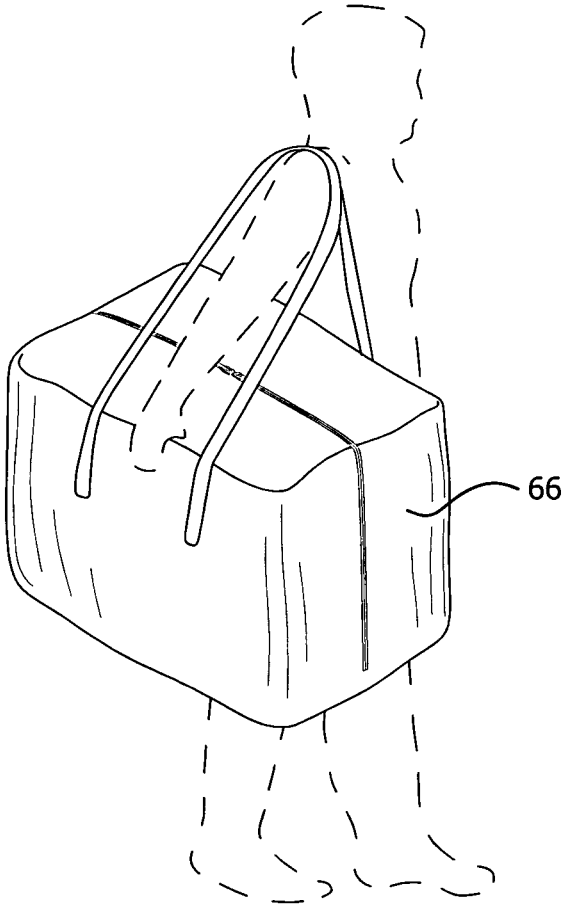
FIG. 7 is a view of a person carrying the collapsed table of the present invention in a carrying bag illustrating the ease in which the table can be transported from one place to another.

Disassembly is performed in the reverse manner. With the table sections disassembled as shown in FIG. 2, they can easily be inserted into a bag such as shown at 66 in FIG. 7 so as to be easily carried and transported to any desired location.

The present invention may be embodied in other specific forms without departing from the spirit or essential attributes thereof. For example, while only one intermediate table section is disclosed, two or more intermediate sections could be utilized to make the table as long as desired. Accordingly, reference should be made to the appended claims rather than to the foregoing specification as indicating the scope of the invention.

I claim:

1. A collapsible table comprising:

a first end table section having an upper substantially planar surface and a second end table section having an upper substantially planar surface, each end table section having a length and a width, each end table section also including an outer edge, an opposed inner edge and a pair of opposed side edges, each end table section further having a lower surface;

each end table section being comprise of two substantially equal halves hinged together along the length of the table section whereby said two halves can be moved between an operative position wherein said end table section exhibits a continuous upper substantially planar surface with said side edges are space from each other and an inoperative folded position wherein the lower surfaces of said halves are in substantial contact and said side edges are next to each other;

means for temporarily connecting the inner edges of said first and second table sections together, said connecting means including a plurality of rods having rectangular cross sections and wherein the inner edge of each of said table sections has a plurality of rectangularly shaped holes into which said rods can be inserted;

a plurality of legs, each of said legs being comprised of two substantially equal length parts that can be connected together lengthwise, the outer dimension of each of the two parts being identical so that either of said two parts can function as a top or as a bottom, and means for temporarily connecting said legs to said lower surface of said first and second table sections.

2. The collapsible table of claim 1 further including an intermediate table section adapted to be interposed between said end table sections.

3. The collapsible table of claim 2 wherein said intermediate table section has a length and a width, a pair of opposed inner edges and a pair of opposed side edges, each of said inner edges of said intermediate table section having a plurality of rectangularly shaped holes therein and being adapted to be connected to said inner edges of said end table sections by said rods being inserted into said holes.

4. The collapsible table of claim 3 wherein said intermediate table section is comprise of two substantially equal halves hinged together along the length thereof whereby said two halves can be moved between an operative position wherein said intermediate table section exhibits a continuous upper substantially planar surface with said side edges are space from each other and an inoperative folded position wherein the lower surfaces of said halves are in substantial contact and said side edges are next to each other.

5. The collapsible table of claim 4 including means for temporarily connecting said legs to said lower surface of said intermediate table section.

6. The collapsible table of claim 5 further including a carrying bag capable of containing said table therein and including a handle for carrying the same.

* * * * *